United States Patent [19]

Brinkmann

[11] Patent Number: 5,075,176

[45] Date of Patent: Dec. 24, 1991

[54] ELECTRICAL CONNECTOR PAIR

[75] Inventor: Hans W. Brinkmann, Stolberg, Fed. Rep. of Germany

[73] Assignee: Stolberger Metallwerke GmbH & Co. KG, Stolberg, Fed. Rep. of Germany

[21] Appl. No.: 650,896

[22] Filed: Feb. 5, 1991

[30] Foreign Application Priority Data

Feb. 23, 1990 [DE] Fed. Rep. of Germany ..... 4005836

[51] Int. Cl.[5] ..... H01R 4/62; H01R 13/03

[52] U.S. Cl. ..... 428/647; 428/646; 428/929; 428/939; 439/886

[58] Field of Search ..... 439/886, 887, 931; 428/643, 644, 646, 647, 648, 929, 931, 939

[56] References Cited

U.S. PATENT DOCUMENTS

| | | | |
|---|---|---|---|
| 2,469,878 | 5/1949 | Hannon et al. | 428/647 |
| 2,816,275 | 12/1957 | Hammell | 439/886 |
| 3,853,382 | 12/1974 | Lazar | 439/886 |
| 3,892,637 | 7/1975 | Polti | 428/647 |
| 3,975,076 | 8/1976 | Shida et al. | 439/886 |
| 4,408,824 | 10/1983 | Weidlen | 439/886 |
| 4,447,109 | 5/1984 | Hobart, Jr. | 439/886 |
| 4,514,032 | 4/1985 | Lawrence | 439/886 |
| 4,749,626 | 6/1988 | Kadija et al. | 428/647 |

FOREIGN PATENT DOCUMENTS

| | | | |
|---|---|---|---|
| 2348606 | 6/1974 | Fed. Rep. of Germany | 439/887 |
| 2482791 | 11/1981 | France | 439/887 |
| 56-15569 | 2/1981 | Japan | 439/887 |
| 61-91394 | 5/1986 | Japan | 428/647 |
| 179871 | 7/1962 | Sweden | 439/887 |

*Primary Examiner*—John J. Zimmermann

*Attorney, Agent, or Firm*—Kenyon & Kenyon

[57] ABSTRACT

In order to reduce the plug-in and tensile pulling forces of an electrical connector pair, the coating on the plug element of a socket and plug connector pair is given greater hardness than that for the other plug element. To this end, the base material (e.g., of a male plug) is given a surface coating of an alloy applied using the molten method. Besides tin and possibly lead (as well as small amounts of deoxidization and processing additives), this alloy also contains up to a total of 10% by weight of at least one element selected from the group consisting of silver, aluminum, silicon, copper, magnesium, iron, nickel, manganese, zinc, zirconium, antimony, rhodium, palladium and platinum. The melting point of the coating material preferably does not exceed 320° C.

10 Claims, No Drawings

ELECTRICAL CONNECTOR PAIR

BACKGROUND OF THE INVENTION

The invention relates generally to an electrical connector pair, whose individual plug elements are made of a base material coated with tin or with a tin alloy. More particularly, the invention relates to coatings for such plug elements that enhance the operating characteristics of the plug elements.

Ideally, one should be able to repeatably mate and separate the electrical connector pair or plug connector with negligible plug-in forces, and without any significant change in the contact resistance. Plug connectors are usually comprised of sockets (or adapter plugs) and plugs, which are manufactured from metal bands (strips) through deformation. The base material used for the connectors is given a complete or partial surface coating before being deformed. This coating is meant to protect the base material from attack by corrosion as well as improve soldering capability.

In general, all metals and metal alloys customarily used in electrical applications are suited for use as the base material. Copper and copper alloys are particularly preferred for use as the base material. It is known to coat the band of the base material either galvanically with tin, or to apply tin or a tin-lead alloy to the metal band in a molten bath.

The coated metal band, and the plug connector manufactured from it, must meet the following requirements:

(1) consistently low contact resistance;
(2) optimally low plug-in and tensile (pulling) forces;
(3) high plug-in and pulling frequencies;
(4) high level of corrosion resistance;
(5) sufficiently high contact force;
(6) good workability;

There remains a need for electrical connector pairs that provide sufficient levels of such qualities, particularly with respect to low plug-in (i.e., insertion) and tensile (pulling out) forces.

SUMMARY OF THE INVENTION

The invention meets this need by providing the base material of the plug el a surface coating of an alloy using the molten bath method. This alloy contains tin and may contain lead, as well as small amounts of deoxidization and processing additives. Additionally, this alloy also contains up to a total of 10% by weight of at least one element selected from the group consisting of silver, aluminum, silicon, copper, magnesium, iron, nickel, manganese, zinc, zirconium, antimony, rhodium, palladium and platinum.

The provision of such a coating to one member of an electrical connector pair provides the desired properties, particularly with respect to low plug-in and tensile forces.

DETAILED DESCRIPTION

Analyses of the plug-in and tensile pulling forces of plug connectors have unexpectedly shown that these forces depend to a great extent on the hardness of the surface coating on the individual connector elements. If the coating of the base material on one of the two individual plug elements, for example on the plug, has a greater hardness than the coating on the other plug element, a reduction in the plug-in force of up to 60% results relative to the plug systems whose individual plug elements have a coating of pure tin.

The provision of a harder surface coating to one of the connecting partners of the plug system (be it a single-pole or a multi-pole system) helps to reduce the plug-in and tensile (pulling) forces associated with the connectors. Additionally, the harder coating also improves corrosion protection and increases longevity of the connection system by increasing the number of times the plug can be inserted and withdrawn from its corresponding socket.

Characteristic the coatings applied to the metal band using molten bath methods is the presence of a thin layer of an intermetallic phase at the boundary surface to the base material. This is due to the reaction of the metal band in the molten bath. This intermediate layer can have a thickness from 0.1 to 1 um, depending upon process conditions.

The invention increases the hardness of the surface coating by adding at least one element, which, with tin, preferably forms mixed crystals, or intermetallic-phases, for example Hume-Rothery phases.

The electrical conductivity and the associated contact resistance are dependent upon the lattice structures and the crystalline construct of the alloying partners. As a rule, the orderly structure found in intermetallic phases promotes conductivity, while an alloy formation causes conductivity to be reduced. On the other hand, alloys are normally harder than pure metals.

These two contrary effects must be optimized through the selection of the additive element to the basic matrix of the pure tin or of the tin-lead alloy. Moreover, the coating material should have the lowest possible melting point. It is desirable that the tin alloy used for the surface coating of the metal band have a melting point of no more than 390° C., and preferably be less than 320° C.

It has proven to be particularly advantageous for the surface coating of the base material of the individual plug elements to be made of a tin alloy containing 0.1 to 8.5% by weight of at least one element selected from the group consisting of silver, aluminum, silicon, copper, magnesium, iron, nickel, manganese, zinc, zirconium, antimony, rhodium, palladium and platinum. The tin-alloy layer precipitated from the molten bath should preferably have a thickness of 0.3 to 12 um. To improve soldering capability, it is particularly advantageous for the coated metal band to undergo a heat treatment in the temperature range of up to 250° C. This measure increases the strength of the coating material.

Based on non-restrictive exemplified embodiments, the invention shall be explained in greater detail in the following.

EXAMPLE 1

An alloy was selected from the tin-silver alloy system with a composition containing 1% by weight of silver and 0.03% by weight of phosphorous. The remainder of the alloy was made up of tin and unavoidable impurities.

A metal band made of the low-alloyed copper alloy CuFe2P (C19400) was coated with the tin alloy using the molten bath tinning method. The temperature of the molten bath was set at approximately 250° C. Sockets of different known plug systems were produced from the coated metal band, whose coating showed a microhardness of 1200 N/mm$^2$. The corresponding plugs of the analyzed plug systems were produced from a suitable metal band with a surface coating of pure tin. The hardness of the pure tin coating amounted thereby to about 600 N/mm$^2$. Due to the varying hardness of the individual plug elements, there resulted a reduction in the plug-in forces of 20 to 50% for the different plug systems, in comparison to a plug system whose plug connector partners each had a coating of pure tin.

EXAMPLE 2

An alloy of a multicomponent tin system was used for coating the base material described in Example 1. This alloy composition of the example contained 5% by weight of antimony, 1% by weight of copper, 0.5% by weight of silver, 0.2% by weight of nickel, 0.2% by weight of zinc, and 0.02% by weight of phosphorous, with the remainder tin. The microhardness of the coatings tested in the practice experiment amounted to 1900N mm$^2$. Plugs of a flat connector were manufactured from the coated metal bands. The corresponding socket or plug socket of this connector consisted of a base material with a pure-tin coating applied using molten bath methods. This combination resulted in, a reduction in the plug-in force by about 50% relative to a connector, whose individual plug elements had a surface coating of pure tin.

What is claimed:

1. An electrical connector pair comprising a first plug element made of a base material and a surface coating of an alloy applied using the molten bath method, said alloy comprising tin, said alloy also comprising an effective amount up to a total of 10% by weight of at least one element selected from the group consisting of silver, aluminum, silicon, copper, magnesium, iron, nickel, manganese, zinc, zirconium, antimony, rhodium, palladium, and platinum, and a second plug element made of a base material and a surface coating applied using the molten bath method wherein said surface coating comprises unalloyed tin.

2. The electrical connector pair according to claim 1, wherein the base material is selected from the group consisting of copper and a copper alloy.

3. The electrical connector pair according to claim 1, wherein said tin alloy contains 0.1 to 8.5% by weight of at least of one element selected from the group consisting of silver, aluminum, silicon, copper, magnesium, iron, nickel, manganese, zinc, zirconium, antimony, rhodium, palladium and platinum, the remainder being tin, including unavoidable impurities.

4. The electrical connector pair according to claim 3, wherein the surface coating of the base material comprises a tin alloy, which contains:

a) up to 4% by weight of silver and/or 0.1 to 6.5% by weight of antimony, b) 0.1 to 2% by weight of copper, c) 0.01 to 0.5% by weight of nickel, and d) up to 0.5% by weight of material selected from the group consisting of zinc, phosphorous, and mixtures thereof.

5. The electrical connector pair according to claim 1, wherein the tin alloy used for the surface coating of the base material has a melting point of less than 390° C.

6. The electrical connector pair according to claim 1 wherein the surface coating of the base material has a thickness of 0.3 to 12 um.

7. The electrical connector pair of claim 1, wherein the coating alloy contains lead.

8. The electrical connector pair of claim 3, wherein up to 40% of the weight of tin is replaced by an equal weight of lead.

9. The electrical connector pair of claim 5, wherein the melting point of the alloy used for the surface coating is less than 320° C.

10. The electrical connector pair of claim 1, wherein the alloy comprises small amounts of deoxidization and processing additives.

* * * * *

UNITED STATES PATENT AND TRADEMARK OFFICE

CERTIFICATE OF CORRECTION

PATENT NO. : 5,075,176

DATED : December 24, 1991

INVENTOR(S) : Hans W. Brinkmann

It is certified that error appears in the above-identified patent and that said Letters Patent is hereby corrected as shown below:

Column 1, line 46, change "el" to --element--.

Column 2, line 12, between "Characteristic" and "the" insert --of--.

Column 3, line 17, change "1900N" to --1900 N--.

Signed and Sealed this

Nineteenth Day of October, 1993

*Attest:*

Bruce Lehman

BRUCE LEHMAN

*Attesting Officer*

*Commissioner of Patents and Trademarks*